US008156854B2

(12) United States Patent
Brown

(10) Patent No.: US 8,156,854 B2
(45) Date of Patent: Apr. 17, 2012

(54) FIREARM HAVING A HANDLE ASSEMBLY FOR CHARGING AND FORWARD ASSIST

(75) Inventor: Michael J. Brown, Baltimore, MD (US)

(73) Assignee: Adcor Industries, Inc., Baltimore, MD (US)

( * ) Notice: Subject to any disclaimer, the term of this patent is extended or adjusted under 35 U.S.C. 154(b) by 474 days.

(21) Appl. No.: 12/496,008

(22) Filed: Jul. 1, 2009

(65) Prior Publication Data

US 2010/0000396 A1 Jan. 7, 2010

Related U.S. Application Data

(60) Provisional application No. 61/133,624, filed on Jul. 1, 2008, provisional application No. 61/196,958, filed on Oct. 22, 2008, provisional application No. 61/211,228, filed on Mar. 27, 2009.

(51) Int. Cl.
*F41A 7/00* (2006.01)
*F41A 3/02* (2006.01)
*F41A 35/00* (2006.01)

(52) U.S. Cl. ..... 89/1.4

(58) Field of Classification Search ..... 89/1.42, 89/1.4, 179, 191.01, 191.02, 192
See application file for complete search history.

(56) References Cited

U.S. PATENT DOCUMENTS

| | | | | |
|---|---|---|---|---|
| 1,379,989 | A | | 5/1921 | Johnson |
| 1,402,459 | A | | 1/1922 | Swebilius |
| 1,846,993 | A | | 2/1932 | Destree |
| 1,878,038 | A | | 9/1932 | Von Frommer |
| 2,056,577 | A | * | 10/1936 | Kehne ..... 89/1.4 |
| 2,341,767 | A | | 2/1944 | Gans |
| 2,454,885 | A | * | 11/1948 | Robinson, Jr. ..... 42/16 |
| 2,462,119 | A | | 2/1949 | Moore |
| 2,685,754 | A | | 8/1954 | Crittendon et al. |
| 2,752,826 | A | | 7/1956 | Simpson |
| 2,775,166 | A | | 12/1956 | Janson |
| 2,780,145 | A | | 2/1957 | Saive |
| 2,783,685 | A | | 3/1957 | Green |
| 2,882,635 | A | | 4/1959 | Hill |
| 2,951,424 | A | | 9/1960 | Stoner |

(Continued)

OTHER PUBLICATIONS

Article entitled "The USA's M4 Carbine Controversy" dated Feb. 21, 2009; www.defenseindustrydaily.com/the-usas-m4-carbine-controversy-03289/.

(Continued)

*Primary Examiner* — Troy Chambers
(74) *Attorney, Agent, or Firm* — Howard & Howard Attorneys PLLC

(57) ABSTRACT

A firearm includes a receiver and a bolt carrier disposed in the receiver. The bolt carrier is moveable between a firing position and a rearward position. A rod is fixed relative to the bolt carrier and a hand guard is coupled to the receiver about the rod. A handle assembly is slideably supported by the hand guard and is moveable toward the receiver to define a charging motion and away from the receiver to define a forward assist motion. The handle assembly receives the rod during both of the charging and forward assist motions. An arm is coupled to the base and is moveable between a disengaged position spaced from the rod and an engaged position abutting the rod. When the arm is in the engaged position, the handle assembly is moved to move the rod and the bolt carrier in either of the charging and the forward assist motions.

37 Claims, 14 Drawing Sheets

U.S. PATENT DOCUMENTS 3,176,424 A 4/1965 Hoge
3,198,076 A 8/1965 Stoner
3,225,653 A * 12/1965 Packard ..... 89/1.4
3,236,155 A 2/1966 Sturtevant
3,255,667 A 6/1966 Walther
3,300,889 A 1/1967 Baker
3,323,418 A * 6/1967 Loffler ..... 89/193
3,368,298 A 2/1968 Browning
3,397,473 A 8/1968 Browning
3,405,470 A 10/1968 Wesemann
3,592,101 A 7/1971 Vartanian et al.
3,618,457 A 11/1971 Miller
3,619,926 A 11/1971 Alday
3,675,534 A 7/1972 Beretta
3,686,998 A 8/1972 Seifried
3,742,636 A 7/1973 Dealy et al.
3,771,415 A 11/1973 Into et al.
3,774,498 A 11/1973 Moller et al.
3,776,095 A 12/1973 Atchisson
3,938,271 A 2/1976 Hyytinen
3,938,422 A 2/1976 Tellie
3,960,053 A 6/1976 Conley
3,969,980 A 7/1976 Brandstatter et al.
3,999,461 A 12/1976 Johnson et al.
4,020,741 A 5/1977 Junker
4,044,487 A 8/1977 Hutton et al.
4,088,057 A 5/1978 Nasypany
4,125,054 A 11/1978 Jennie
4,244,273 A 1/1981 Langendorfer, Jr. et al.
4,246,830 A 1/1981 Krieger
4,358,986 A 11/1982 Giorgio
4,389,920 A 6/1983 Dufour, Sr.
4,398,448 A 8/1983 LaFever
4,505,182 A 3/1985 Sullivan
4,553,469 A 11/1985 Atchisson
4,565,113 A * 1/1986 Bunning ..... 89/1.4
4,654,993 A 4/1987 Atchisson
4,663,875 A 5/1987 Tatro
4,689,911 A 9/1987 White
4,693,170 A 9/1987 Atchisson
4,703,826 A 11/1987 Byron
4,756,228 A 7/1988 Roth
4,765,224 A 8/1988 Morris
4,766,800 A 8/1988 Miller et al.
4,867,039 A 9/1989 Dobbins
4,893,547 A 1/1990 Atchisson
4,972,617 A 11/1990 Major
5,198,600 A 3/1993 E'Nama
5,343,650 A 9/1994 Swan
5,351,598 A 10/1994 Schuetz
5,540,008 A 7/1996 Kirnstatter
5,821,445 A 10/1998 Guhring
5,824,923 A 10/1998 Kondoh et al.
5,827,992 A 10/1998 Harris et al.
5,918,401 A 7/1999 Rowlands
5,945,626 A 8/1999 Robbins
6,019,024 A 2/2000 Robinson et al.
6,134,823 A 10/2000 Griffin
6,257,114 B1 * 7/2001 Murello ..... 89/1.42
6,311,603 B1 11/2001 Dunlap
6,418,655 B1 7/2002 Kay
6,453,594 B1 9/2002 Griffin
6,481,145 B2 11/2002 Weichert et al.
6,499,246 B1 12/2002 Zedrosser
6,508,158 B2 1/2003 Murello
6,564,491 B2 5/2003 Murello
6,609,321 B2 8/2003 Faifer
6,619,592 B2 9/2003 Vignaroli et al.
6,625,916 B1 9/2003 Dionne
6,634,274 B1 10/2003 Herring
6,722,255 B2 4/2004 Herring
6,732,466 B2 5/2004 Bentley
6,782,791 B2 8/2004 Moore
6,829,858 B2 12/2004 Gablowski
6,848,351 B1 2/2005 Davies
7,000,345 B1 2/2006 Kay
7,131,228 B2 11/2006 Hochstrate et al.
RE39,465 E 1/2007 Swan
7,219,463 B2 * 5/2007 Wossner ..... 42/70.11
7,231,861 B1 * 6/2007 Gauny et al. ..... 89/1.4
7,240,600 B1 * 7/2007 Bordson ..... 89/1.4
7,418,898 B1 9/2008 Desomma
7,448,307 B1 11/2008 Dafinov
7,461,581 B2 12/2008 Leitner-Wise
7,469,624 B1 12/2008 Adams
7,478,495 B1 1/2009 Alzamora et al.
7,798,045 B1 * 9/2010 Fitzpatrick et al. ..... 89/1.4
7,832,322 B1 * 11/2010 Hoel ..... 89/1.4
7,849,777 B1 * 12/2010 Zedrosser ..... 89/1.4
2003/0074822 A1 4/2003 Faifer
2005/0115134 A1 6/2005 Bond et al.
2005/0115398 A1 6/2005 Olson
2005/0262752 A1 12/2005 Robinson et al.
2006/0065112 A1 3/2006 Kuczynko et al.
2006/0156606 A1 7/2006 Robinson et al.
2006/0236582 A1 10/2006 Lewis et al.
2006/0254112 A1 11/2006 Snoderly
2007/0033851 A1 2/2007 Hochstrate et al.
2007/0199435 A1 8/2007 Hochstrate et al.
2008/0110074 A1 5/2008 Bucholtz et al.
2009/0000173 A1 1/2009 Robinson et al.
2009/0007477 A1 1/2009 Robinson et al.
2009/0031605 A1 2/2009 Robinson
2009/0031606 A1 2/2009 Robinson et al.
2009/0031607 A1 2/2009 Robinson et al.
2009/0064556 A1 * 3/2009 Fluhr et al. ..... 42/14

OTHER PUBLICATIONS

Article entitled "M4 Carbine Review" dated May 21, 2007; http://home.comcast.net/ shooter2_indy/m4.html.
Article entitled "Critics Turn Crosshairs on Military's Main Rifle" dated Apr. 20, 2008 from the website "USA Today"; www. usatoday.com/news/military/2008-04-20-gunwars_N.htm.
Parts Schematic entitled "Schematic for Bushmaster M4A3 Carbine" from the website "Bushmaster" dated Jun. 2008; www.bushmaster.com/electronic-documents/operation-manual/opmanual.pdf.
Article entitled "M26 Modular Accessory Shotgun Systems Photos and Video" from the website "The Firearm Blog" dated Nov. 2, 2007; www.thefirearmblog.com/blog/2007/11/02/m26-modular-accessory-shotgun-system-photos-and-video/.
Catalog item LMT: Standard MRP (rifle) version from the website "Lewis Machine Tool Company" dated Jun. 2008; www.lewismachine.net/product.php?p=56&cid=8&session=85945e8b595ef2d461b8980961cf870a.
Article entitled "M26 Modular Accessory Shotgun System" from Wikipedia, the free encyclopdia dated Jun. 2008; http://en.wikipedia.org/wiki/M26_Modular_Accessory_Shotgun_System.
Article entitled "M16 rifle" from Wikipedia, the free encyclopedia dated Jun. 2008; http://en.wikipedia.org/wiki/M-16_rifle.
Article entitled "M4 Carbine" from Wikipedia, the free encyclopedia dated Jun. 2008; http://en.wikipedia.org/wiki/M4_carbine.
Animation entitled "How an AR15 Works" from the website dated Jun. 2008; www.barnesengineering.com/AR15animation/index.htm.

* cited by examiner

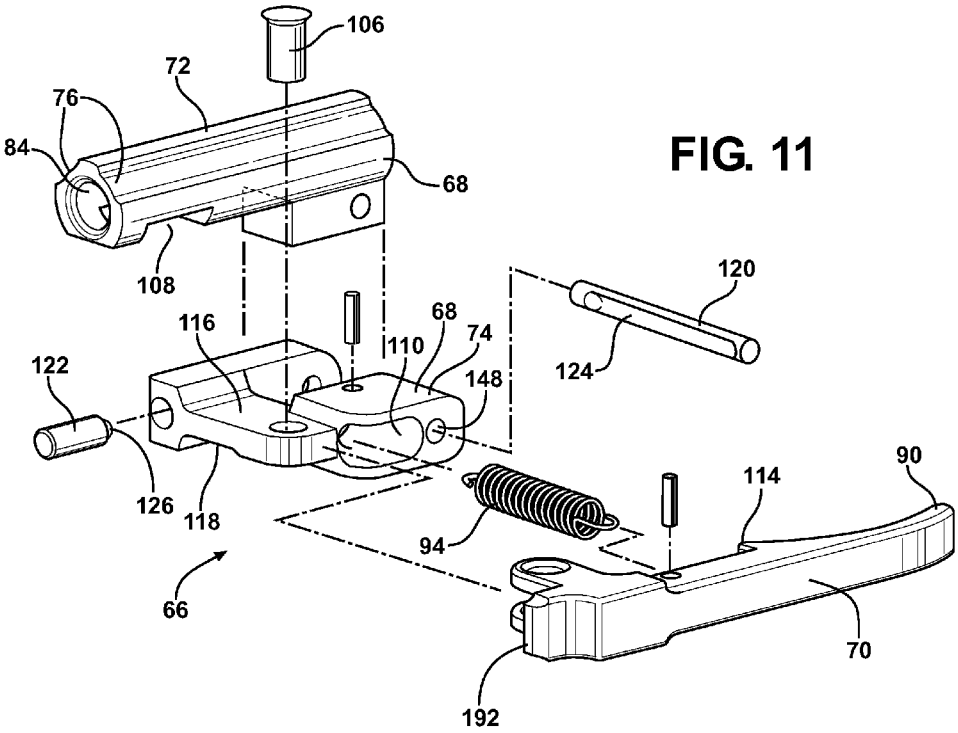
FIG. 11
FIG. 12
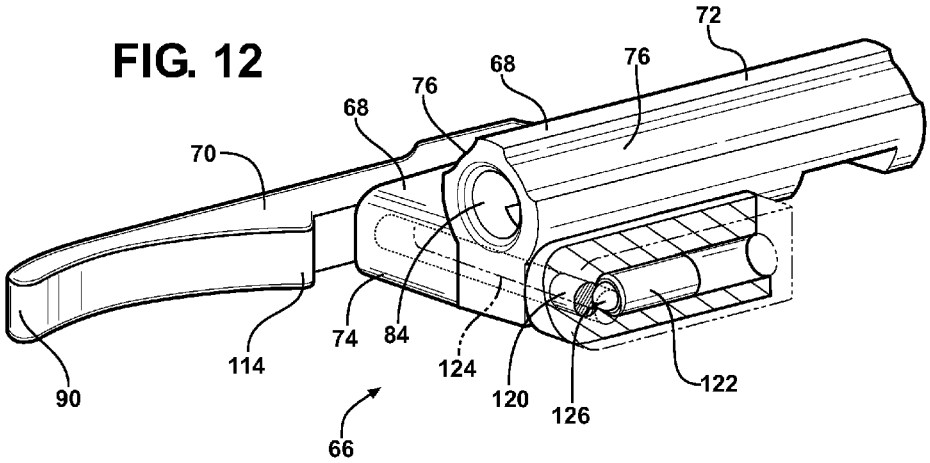

FIREARM HAVING A HANDLE ASSEMBLY FOR CHARGING AND FORWARD ASSIST

CROSS-REFERENCE TO RELATED APPLICATIONS

The subject patent application claims priority to and all the benefits of U.S. Provisional Patent Application No. 61/133,624, which was filed on Jul. 1, 2008; U.S. Provisional Patent Application No. 61/196,958, which was filed on Oct. 22, 2008; and U.S. Provisional Patent Application No. 61/211,228, which was filed on Mar. 27, 2009.

BACKGROUND OF THE INVENTION

1. Field of the Invention

The subject invention relates to firearms and more specifically to a device for moving components of the firearm in a charging motion and in a forward assist motion.

2. Description of the Related Art

Firearms typically include a receiver that houses several working components of the firearm, including firing components, with a barrel extending from the receiver. There are various classes of firearms that operate in different manners. One class of firearm utilizes a bolt carrier disposed in the receiver that is moveable between a firing position, from which a live round of ammunition can be fired, and a retracted position, from which a spent casing is ejected. The movement of the bolt carrier and ejection of the casing can be accomplished with a direct gas impingement or indirect gas impingement system. Examples of gas impingement type firearms include the M16, the M4®, such as the M4® carbine, and the AR-15®, such as the AR-15® Platform.

Firearms having the direct gas impingement system typically include an ejection port defined by the receiver. Direct gas impingement systems route exhaust gases back through the firearm to move the bolt carrier toward the retracted position. In particular, after firing the firearm, the direct gas impingement system routes exhaust gases, including any associated debris, from the barrel, back through a return tube to the bolt carrier, and out the ejection port of the receiver.

Firearms having an indirect gas impingement system do not route the exhaust gases back to the bolt carrier in an effort to reduce fouling caused by the exhaust gases that may occur with direct gas impingement type firearms. Instead, the exhaust gases are used to move a device, such as a piston, that engages the bolt carrier to move the bolt carrier toward the rearward position.

Both the direct and indirect gas impingement systems require an initial manual movement of the bolt carrier from the firing position toward the retracted position to initially load a live round into the firearm. In order to accomplish this manual movement, a device known as a charging handle is provided at the rear of the receiver near the buttstock. A user must lower the firearm and manually grasp the charging handle and pull the charging handle toward the buttstock. The charging handle engages the bolt carrier directly to retract the bolt carrier.

During operation, the bolt carrier automatically moves between the firing and retracted positions to eject a spent casing and to load a live round. Debris can build up in the receiver and about the firing components such that during these operations the firearm can jam or fail with either the casing not being fully ejected or the round not being fully loaded into the firearm. In such situations, the charging handle can be utilized to fully eject the casing. Further, another manual device known as a forward assist can be utilized to complete the loading operation of the live round. The forward assist is a separate device that is also mounted to the rear of the receiver near the buttstock. Again, the user must lower the firearm and manually push on the forward assist, which in turn engages teeth on the bolt carrier in an attempt to move the bolt carrier to the firing position.

Although necessary, the lowering of the firearm during combat situations to perform these tasks is undesirable. Further, it is inefficient to have the charging handle and the forward assist be two separate mechanisms. As such, there remains a need to improve these components and their associated operation.

SUMMARY OF THE INVENTION AND ADVANTAGES

The present invention includes a firearm comprising a receiver defining a receiver bore extending along a longitudinal axis. A bolt carrier is disposed in the receiver bore and is moveable relative to the receiver along the longitudinal axis between a firing position and a rearward position. A rod, also referred to as an elongated member, is fixed relative to the bolt carrier and extends substantially parallel to the longitudinal axis. A hand guard is coupled to the receiver and is disposed about the rod. A handle assembly is slideably supported by the hand guard and is moveable toward the receiver to define a charging motion and away from the receiver to define a forward assist motion with the handle assembly engaging the rod and moving the rod and the bolt carrier toward the rearward position when moved in the charging motion. The handle assembly includes a base having a base bore receiving the rod during both of the charging and forward assist motions. An arm is coupled to the base and is moveable between a disengaged position spaced from the rod and an engaged position abutting the rod with the arm moving the rod and the bolt carrier toward the firing position when in the engaged position and when the handle assembly is moved in the forward assist motion.

The present invention also includes a charging mechanism for a firearm. The charging mechanism comprises a bolt carrier extending along a longitudinal axis. A rod is fixed relative to the bolt carrier and extends substantially parallel the longitudinal axis and defines a recess extending transverse to the longitudinal axis. A handle assembly has a base defining a base bore receiving the rod substantially parallel to the longitudinal axis. The handle is moveable with the rod in one direction along the longitudinal axis in a charging motion and in an opposite direction along the longitudinal axis in a forward assist motion. The handle assembly engages the rod during the charging motion for moving the bolt carrier toward a rearward position. The handle assembly has an arm supported by the base and is selectively moveable transversely to the longitudinal axis between a disengaged position spaced from the rod and an engaged position abutting the rod in the recess wherein the arm in the engaged position is fixed to the rod for moving the bolt carrier toward a firing position during movement of the handle assembly in the forward assist motion.

The present invention also includes a handle assembly for a charging mechanism of a firearm having a bolt carrier and a rod fixed relative to and extending from the bolt carrier. The handle assembly comprises a body defining a body bore extending along a body bore axis for slideably receiving the rod along the body bore axis. A ledge extends into the body bore for engaging the rod when moved in a charging motion to move the bolt carrier toward a rearward position. A slider is fixed to the body and extends transversely to the body bore axis for slideably engaging the firearm in the charging motion and a forward assist motion. An arm is supported by the slider and is selectively moveable transversely to the body bore axis between a disengaged position disposed outside of the body bore and an engaged position disposed at least partially in the body bore for engaging the rod when moved in the forward assist motion to move the bolt carrier toward a firing position.

Accordingly, the handle assembly is used to move the bolt carrier both toward the rearward position, by moving the handle assembly in the charging motion, and toward the firing position, by moving the handle assembly in the forward assist motion. Such a configuration advantageously simplifies the operation of the firearm by eliminating the need for separate components disposed at separate locations of the firearm to separately perform charging and forward assist functions. In addition, the handle assembly is disposed in a position that does not require a user to lower the firearm. As such, during operation, the user can immediately reach for a single component, i.e., the handle assembly, regardless of whether the user seeks to move the bolt carrier toward the rearward position or the firing position without lowering the firearm and without worrying about reaching for a particular component disposed at a particular location to perform a particular function.

Also, the construction of the firearm is simplified by a reduction in the number of components because the charging function and the forward assist function are both accomplished with a single component, i.e., the handle assembly. The reduction in the number of components is advantageous in minimizing weight and minimizing the risk of malfunction in the field.

As mentioned above, the handle assembly allows for the user to perform the charging function and the forward assist function while maintaining the firearm in a ready position and without breaking visual contact with an engaged target.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 11 is an exploded perspective view of the first embodiment of the handle assembly.

FIG. 12 is a partially cross-sectional perspective view of the first embodiment of the handle assembly including a plunger engaged with an assembly pin.

DETAILED DESCRIPTION OF THE INVENTION

Figure 1:
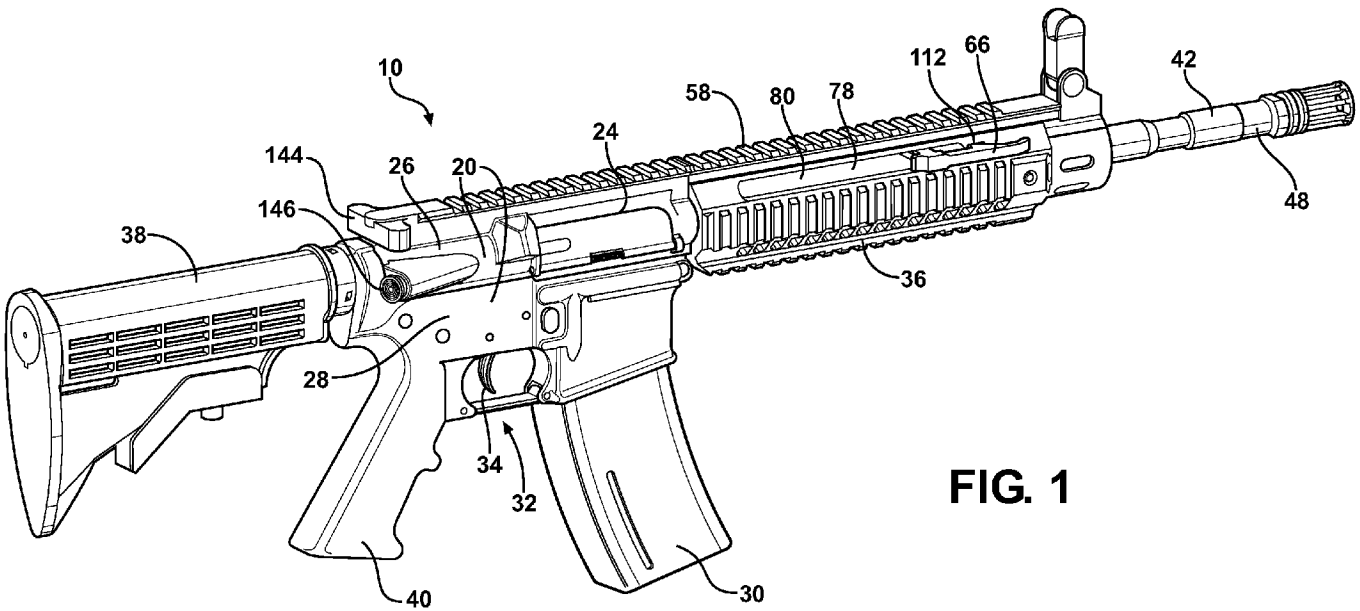
FIG. 1 is a perspective view of an embodiment of a firearm.
Figure 2:
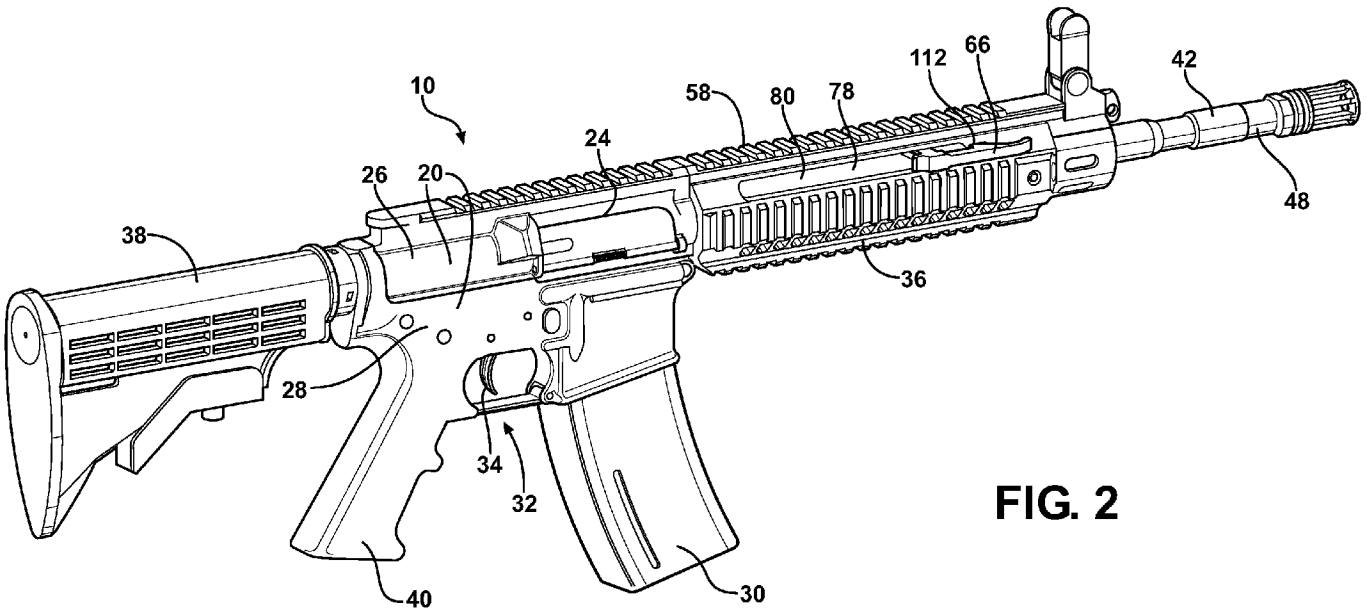
FIG. 2 is a perspective view of another embodiment of the firearm.
Figure 3:
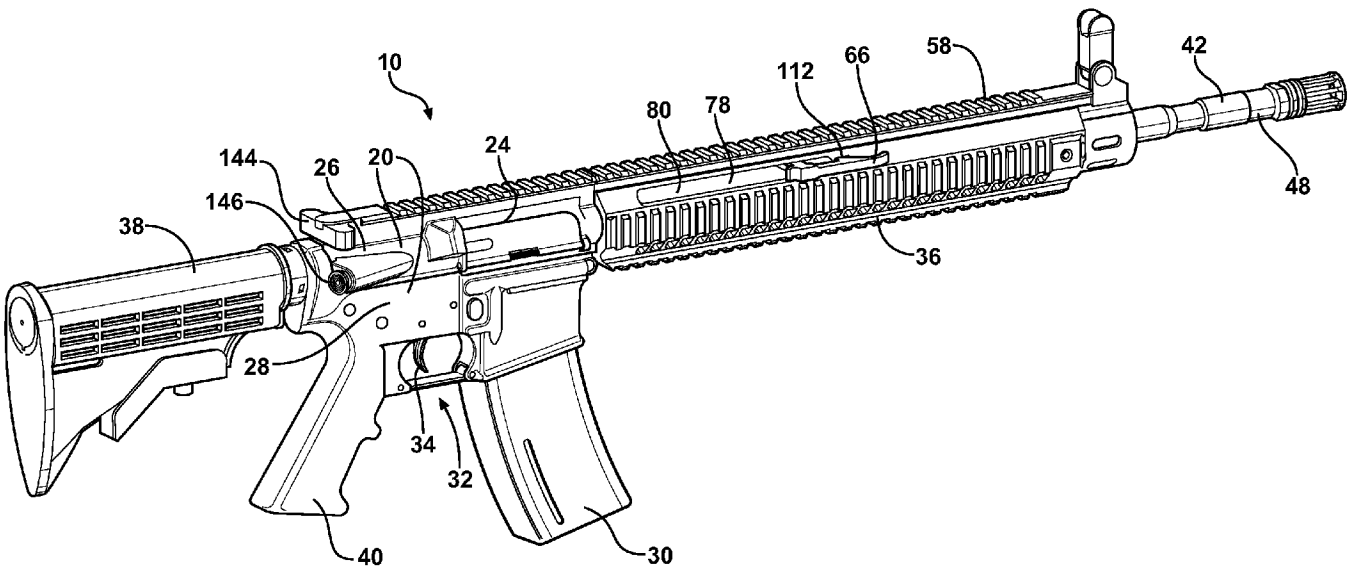
FIG. 3 is a perspective view of yet another embodiment of the firearm.
Figure 4:
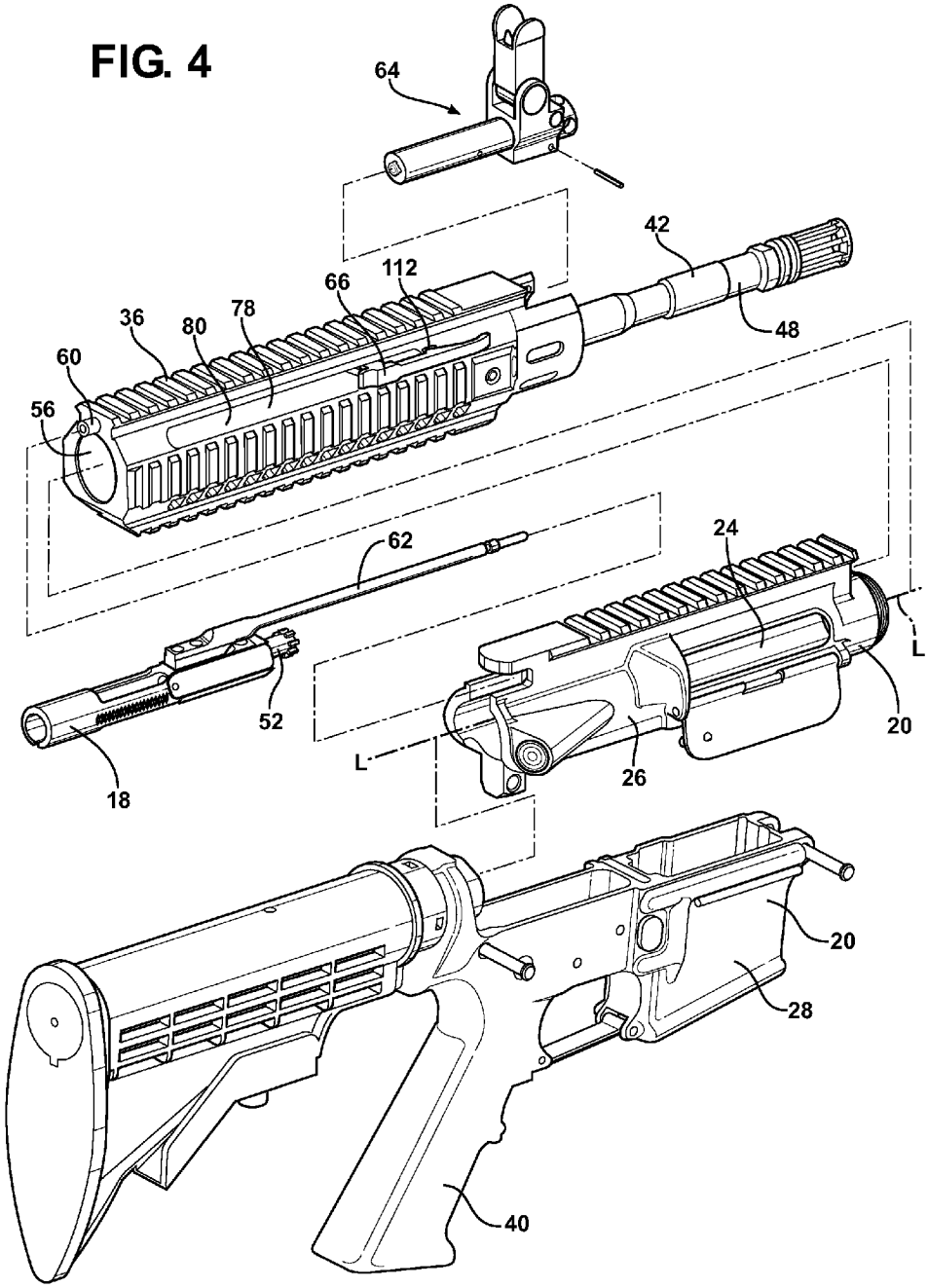
FIG. 4 is an exploded view of selected components of the firearm.
Figure 5:
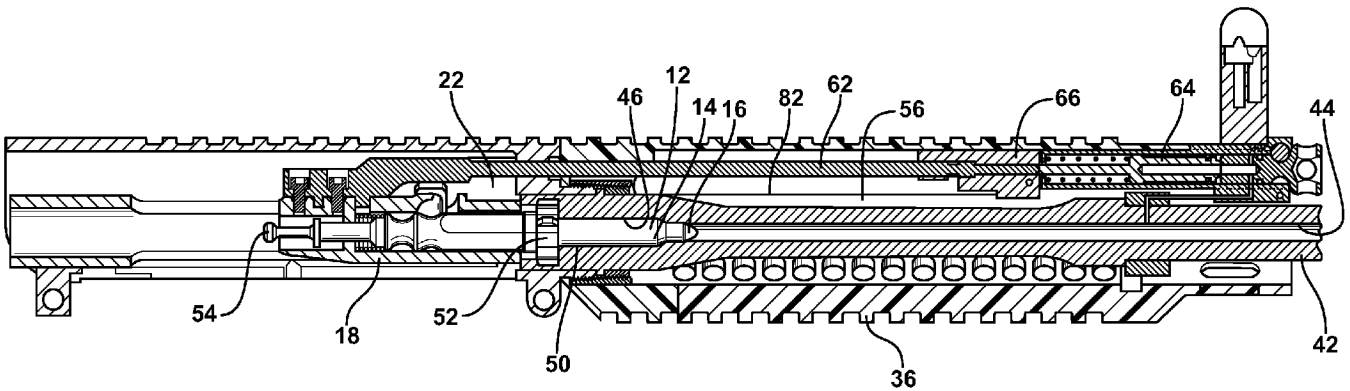
FIG. 5 is a fragmented cross-sectional view of the bolt carrier and the rod in a firing position.
Figure 6:
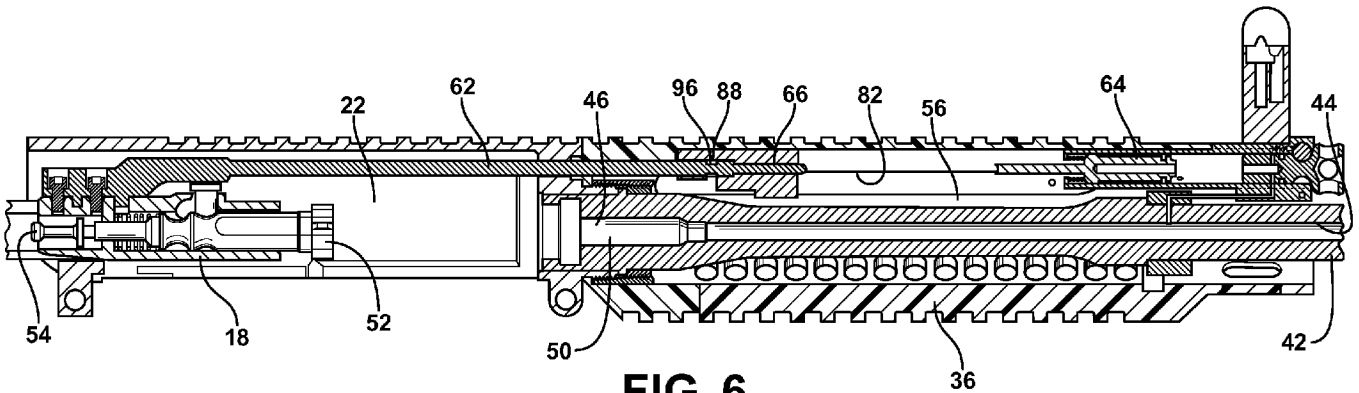
FIG. 6 is a fragmented cross-sectional view of the bolt carrier and the rod in a rearward position.

Referring to the Figures, wherein like numerals indicate like or corresponding parts throughout the several views, a firearm 10 is generally shown in FIGS. 1-3. As discussed in greater detail below, FIGS. 1-3 disclose three different embodiments of the firearm 10. Referring to FIGS. 5 and 6, the firearm 10 receives and fires a live round 12 of ammunition (hereinafter "live round 12"), also referred to as a cartridge, which includes a casing 14, a bullet 16, and other components to propel the bullet 16 as known to those skilled in the art.

The firearm 10 can be of a certain class of firearms 10 that utilize a direct gas impingement system or an indirect gas impingement system to eject a spent casing 14 after firing the firearm 10. Examples of such types of firearms 10 include the M16, the M4®, such as the M4® carbine, and the AR-15®, such as the AR-15® Platform. However, it should be appreciated that the firearm 10 can be of any type without departing from the nature of the present invention. The firearm 10 described herein is designed to permit easy retro-fitting of the components to a variety of currently and/or previously manufactured firearm 10 designs including direct gas impingement systems and indirect gas impingement systems. The indirect gas impingement system utilizes a piston assembly 64 for moving a bolt carrier 18, as further disclosed and claimed in U.S. patent application Ser. No. 12/496,000 filed concurrently with the present application, which is incorporated herein by reference.

Referring to FIGS. 1-4, the firearm 10 includes a receiver 20 defining a receiver bore 22 extending along a longitudinal axis L and houses several working components of the firearm 10, such as the firing components, i.e. the action. As used herein, the phrase "along the longitudinal axis L" includes components and/or movements aligning with the longitudinal axis L and/or spaced from and substantially parallel to the longitudinal axis L. The receiver 20 defines an ejection port 24 transverse to the longitudinal axis L for discharging spent casings. As known in the art, the receiver 20 is often divided into an upper receiver portion 26 and a lower receiver portion 28 attached to the upper receiver portion 26. The upper receiver portion 26 defines the receiver bore 22 and the ejection port 24.

As shown in FIGS. 1-3, a magazine 30, also referred to as a clip, is detachably mounted to the lower receiver 28 and can be loaded with a plurality of live rounds 12. The firearm 10 further includes a trigger assembly 32 supported by the receiver 20. The trigger assembly 32 includes a trigger 34 and a hammer (not shown). The trigger 34 is pulled to move the hammer, which, as discussed further below, ultimately results in the firing of the firearm 10.

The firearm 10 includes a hand guard 36 that extends from the receiver 20 such that a user can hold the hand guard 36 of the firearm 10. A buttstock 38 extends rearwardly from the receiver 20 for supporting the firearm 10 against a shoulder of the user. A hand grip 40 extends downwardly along the lower receiver 28 for gripping by the user.

A barrel 42 is coupled to the receiver 20 and defines a barrel bore 44 extending along the longitudinal axis L. The details of how the barrel 42 is coupled to the receiver 20 is further disclosed and claimed in U.S. patent application Ser. No. 12/496,003 filed concurrently with the present application, which is incorporated herein by reference. The barrel 42 includes a breech 46 adjacent the receiver 20 and a muzzle 48 spaced from the breech 46 along the longitudinal axis L with the breech 46 defining a chamber 50 extending along the longitudinal axis L for receiving one of the live rounds 12. The live rounds 12 are individually loaded into the chamber 50 from the magazine 30. The chamber 50 aligns with the barrel bore 44 such that the bullet 16 moves out of the chamber 50 and the barrel bore 44 when firing the firearm 10.

The bolt carrier 18 is disposed in the receiver bore 22. The bolt carrier 18 is moveable relative to the receiver 20 along the longitudinal axis L between a firing position, shown in FIG. 5, and a rearward position, as shown in FIG. 6. Specifically, a bolt 52 and a firing pin 54 are carried by the bolt carrier 18. The bolt carrier 18 typically has features for automatically releasing another live round 12 from the magazine 30 into the chamber 50 as the bolt carrier 18 moves toward the firing position. As the bolt carrier 18 moves from the rearward position toward the firing position, the bolt carrier 18 catches or pushes another live round 12 into the chamber 50 of the barrel 42. In the firing position, the bolt 52 locks to the breech 46 of the barrel 42 to hold the live round 12 in the chamber 50. The firing components can include the bolt carrier 18, the bolt 52, the firing pin 54, the trigger 34, and the hammer and other components as known to those of skilled in the art.

When the bolt 52 is in the firing position, the trigger 34 can be pulled to release the hammer, which strikes the firing pin 54. When the hammer strikes the firing pin 54, the firing pin 54 strikes the live round 12 to fire the live round 12, which causes the bullet 16 to move through and out of the bore of the barrel 42. After firing the live round 12, the bolt carrier 18 is moved by a gas impingement system toward the rearward position and the casing 14, which is now empty, is expelled from the receiver 20. The bolt carrier 18 is automatically moved toward the firing position thereby automatically loading another live round 12 from the magazine 30 into the chamber 50.

Figure 7:
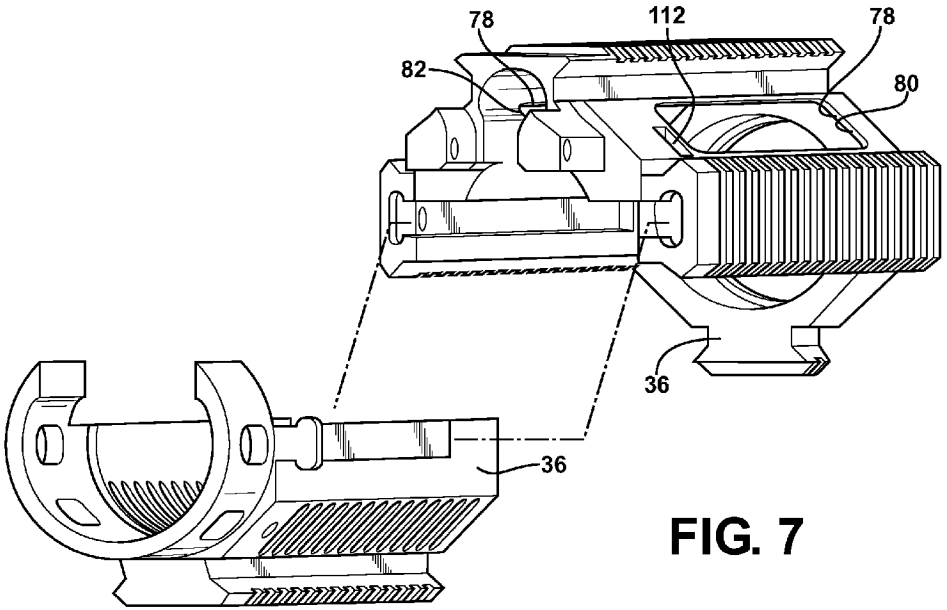
FIG. 7 is an exploded view of a hand guard including a first hand guard portion and a second hand guard portion.
Figure 8:
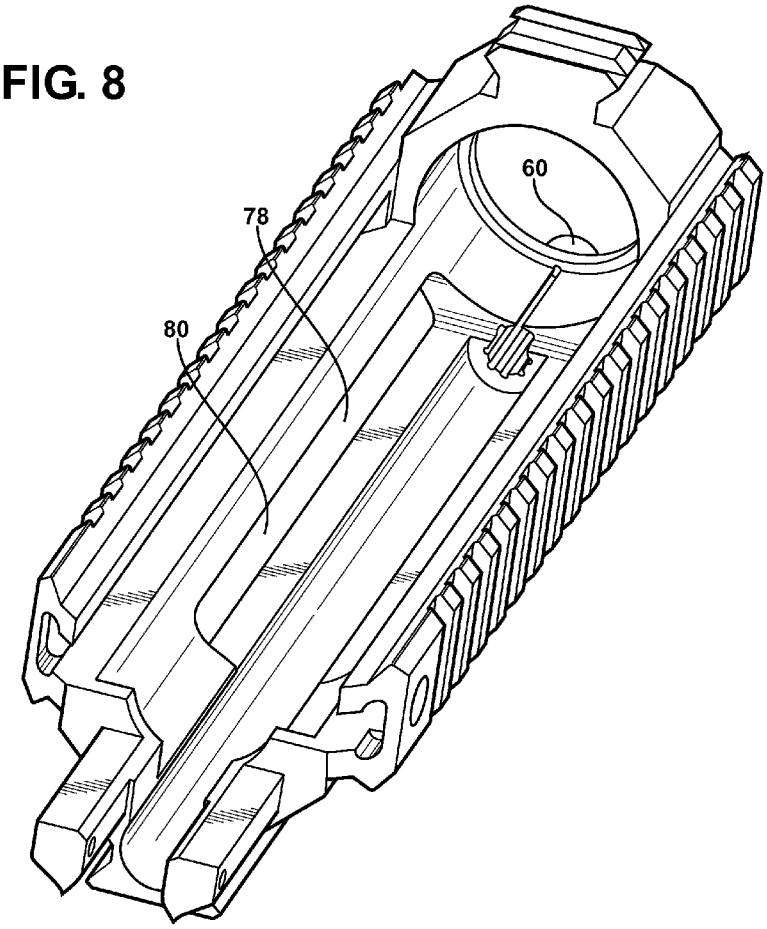
FIG. 8 is an interior perspective view of the first hand guard portion.
Figure 10:
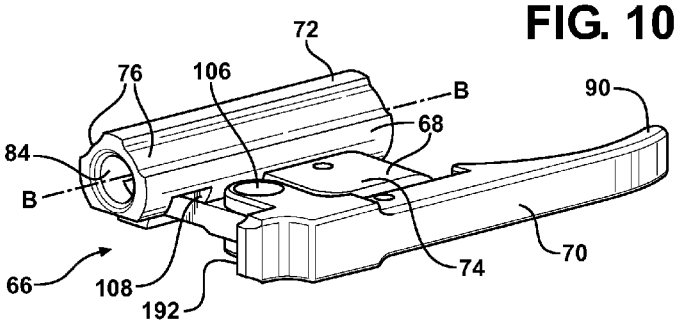
FIG. 10 is a perspective view of the first embodiment of the handle assembly.
Figure 9:
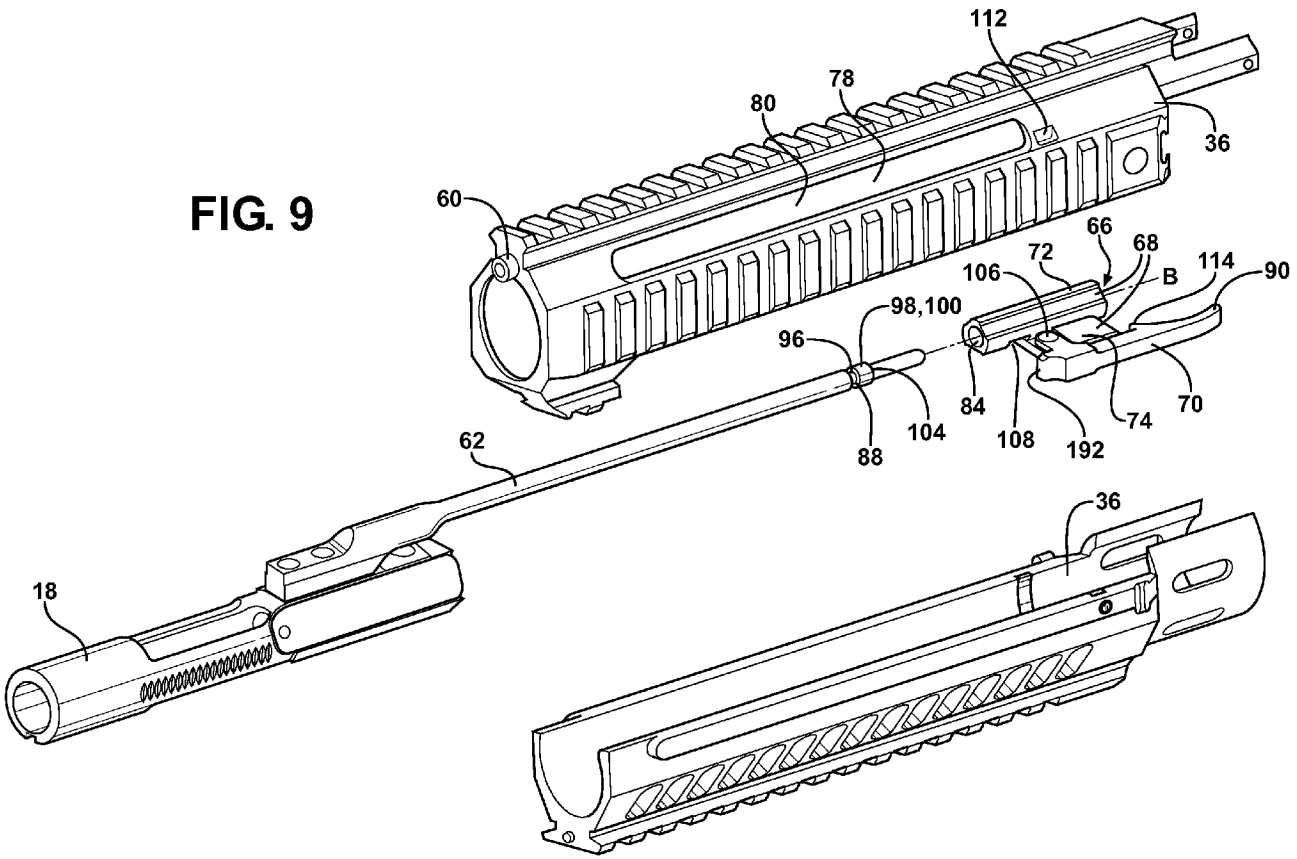
FIG. 9 is a partially exploded view of a bolt carrier, a rod, a first embodiment of a handle assembly, and the hand guard.

The hand guard 36 is also shown in FIGS. 7-9. The hand guard 36 is coupled to the receiver 20 and extends along the longitudinal axis L about the barrel 42. The particulars of the hand guard 36 and the barrel 42 are disclosed and claimed in U.S. patent application Ser. No. 12/496,003 filed concurrently with the present application, which, as stated above, is incorporated herein by reference. However, it is appreciated that the hand guard 36 and the barrel 42 can be of any type without departing from the nature of the present invention.

The hand guard 36 defines a hand guard bore 56 extending substantially parallel to the longitudinal axis L. The barrel 42 extends from the receiver 20 through the hand guard bore 56. The hand guard 36 protects the user's hand from Heat generated by the firing of the fireman 10. The hand guard 36 can include a series of connection points that are known in the industry as a rail system 58 for mounting additional components to the hand guard 36. For example, such components can include bipods, tripods, scopes, bayonets, lasers, shot guns, grenade launchers, etc.

The hand guard 36 includes a bushing 60 extending substantially parallel to the longitudinal axis L for locating the hand guard 36 relative to the receiver 20. Specifically, the bushing 60 extends into the receiver 20. It is to be appreciated that the hand guard 36 can be attached to the receiver 20 in any fashion without departing from the nature of the present invention.

As best shown in FIGS. 4-6 and 9, a rod 62, also referred to as an elongated member, is fixed relative to the bolt carrier 18 and extends substantially parallel to the longitudinal axis L. The hand guard 36 is disposed about the rod 62. An interior of the bushing 60 receives the rod 62. As shown in FIG. 8, the interior of the bushing 60 is splined to accommodate for thermal expansion due to heat generated by operation of the firearm and to accommodate for dirt in the hand guard bore 56.

The rod 62 is coupled to a piston assembly 64 that automatically moves the rod 62 and bolt carrier 18 from the firing position to the rearward position. When in the rearward position, the rod 62 and bolt carrier 18 typically move from the rearward position to the firing position automatically. The rod 62, bolt carrier 18, and piston assembly 64 are disclosed and claimed in U.S. patent application Ser. No. 12/496,000 filed concurrently with the present application, which is incorporated herein by reference.

As best shown in FIGS. 9-20, the firearm 10 includes a handle assembly 66, 166. A first embodiment of the handle assembly 66 is shown in FIGS. 1-6 and 9-14 and a second embodiment of the handle assembly 166 is shown in FIGS. 15-20. Common features between the first and second embodiments are identified with common terms and reference numerals. Features of the first and second embodiment that are structurally different but perform at least some common function are referenced with the common terms and the reference numeral of the second embodiment are increased by 100. It should be appreciated that these two embodiments are exemplary and that the handle assembly may be one of several other embodiments not particularly described herein without departing from the nature of the present invention. The bolt carrier 18, the rod 62, and the handle assembly 66, 166 define a charging mechanism for the subject firearm 10.

The handle assembly 66, 166 is slideably supported by the hand guard 36 and is moveable toward the receiver 20 to define a charging motion and away from the receiver 20 to define a forward assist motion. As set forth further below, the handle assembly 66, 166 can selectively engage the rod 62 to move the rod 62 and the bolt carrier 18 when the handle assembly 66, 166 is moved in the charging motion and in the forward assist motion. FIG. 5 shows the bolt carrier 18 in the firing position and FIG. 6 shows the bolt carrier 18 in the rearward position after the handle assembly 66 has been moved toward the receiver 20 in the charging motion.

When the handle assembly 66, 166 is engaged with the rod 62, the handle assembly 66, 166 can be moved in the charging motion to move the rod 62 and the bolt carrier 18 toward the rearward position. Accordingly, the handle assembly 66, 166 can be engaged with the rod 62 and moved in the charging motion to initially load a live round 12 into the receiver 20, i.e., to charge the firearm 10. The handle assembly 66, 166 can also be engaged with the rod 62 and moved in the charging motion to eject an empty casing 14 that has not ejected, e.g., an empty casing 14 that is jammed in the firearm 10.

When the handle assembly 66, 166 is engaged with the rod 62, the handle assembly 66, 166 can be moved in the forward assist motion to move the rod 62 and the bolt carrier 18 toward the firing position. Accordingly, if for some reason the bolt carrier 18 does not automatically move to the firing position, the handle assembly 66, 166 can be engaged with the rod 62 and moved in the forward assist motion to move the bolt carrier 18 to the firing position.

The handle assembly 66, 166 includes a base 68, 168 and an arm 70, 170 supported by the base 68, 168. Specifically, the base 68, 168 includes a body 72, 172 and a slider 74, 174 extending therefrom supporting the arm 70, 170. The slider 74, 174 extends from the body 72, 172 for slideably engaging the firearm 10 in the charging motion and the forward assist motion, as set forth further below.

The slider 74, 174 and the body 72, 172 are fixed to each other. As best shown in FIGS. 10-14, the slider 74 and the body 72 are preferably integral, i.e., formed of a single piece of material. Alternatively, as best shown in FIGS. 16-20, the slider 174 and the body 172 are separately formed and subsequently connected together. The slider 174 and the body 172 can be connected together in any fashion, such as welding, bolting, pinning, etc., without departing from the nature of the present invention.

Figure 15:
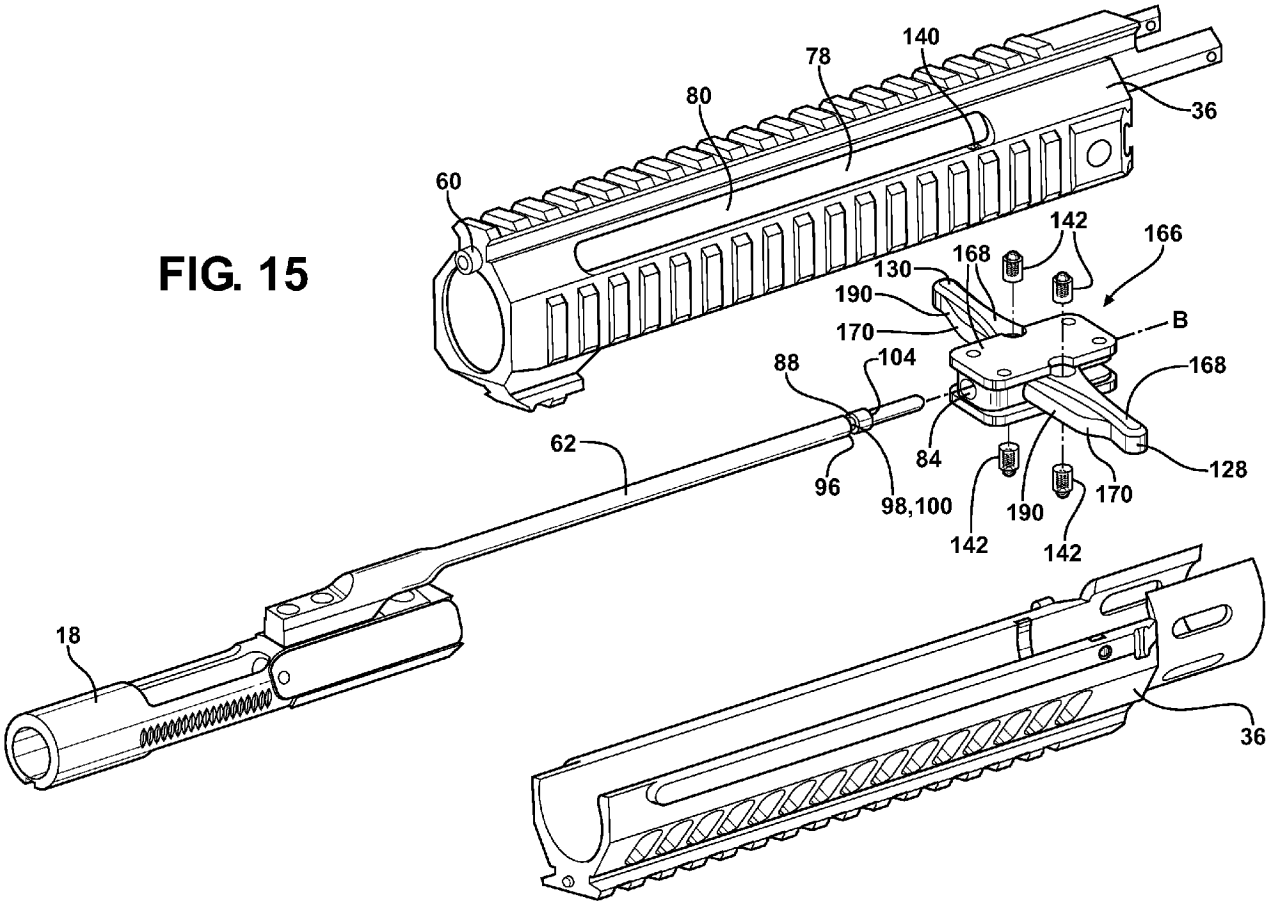
FIG. 15 is a partially exploded perspective view of a bolt carrier, a rod, a second embodiment of a handle assembly, and a hand guard.
Figure 17:
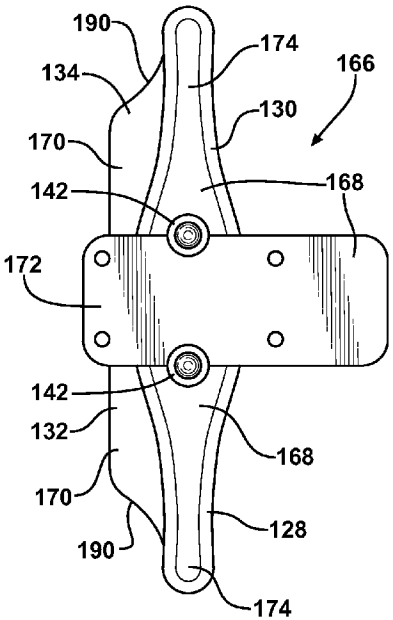
FIG. 17 is a top view of the second embodiment of the handle assembly.
Figure 16:
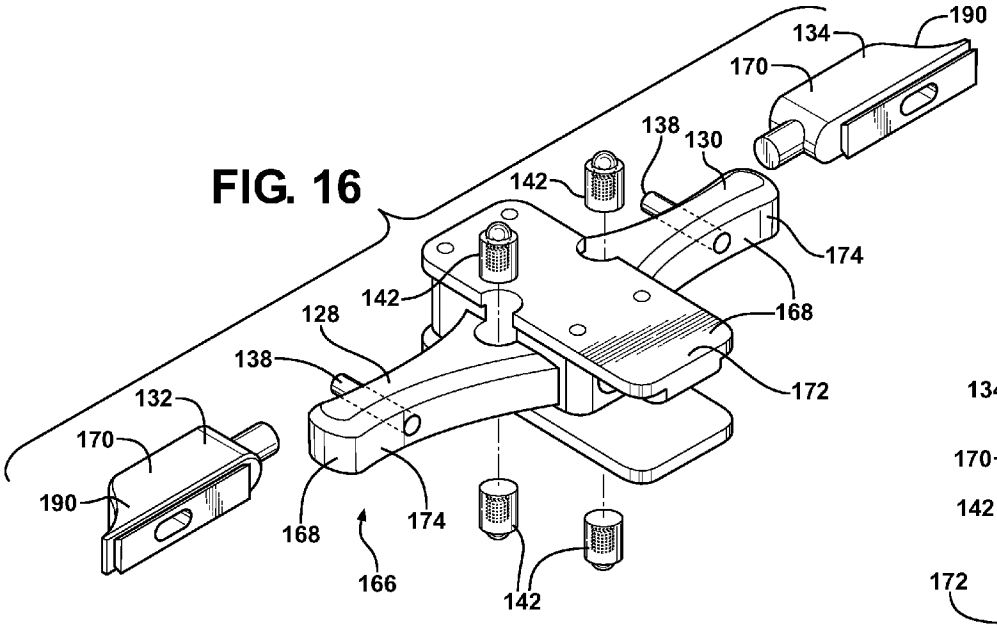
FIG. 16 is a partially exploded perspective view of the second embodiment of the handle assembly.
Figure 18:
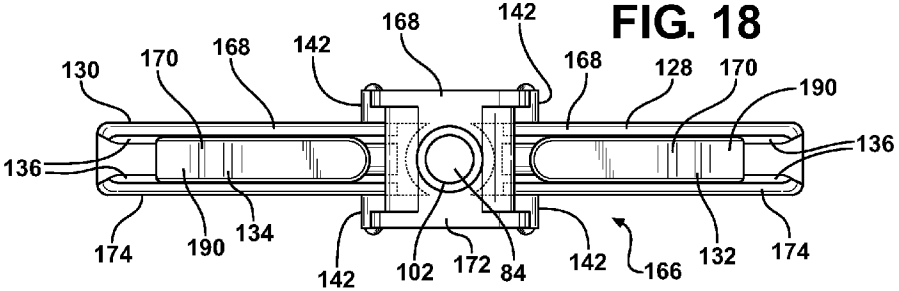
FIG. 18 is a front end view of the second embodiment of the handle assembly.

As shown in FIGS. 9 and 15, the body 72, 172 of the handle assembly 66, 166 is disposed in the hand guard bore 56 and has a complimentary configuration to the hand guard bore 56 such that the body 72, 172 can slide along the hand guard bore 56. The base 68, 168 has a shape that allows the base 68, 168 to freely slide along the hand guard bore 56 without binding within the hand guard bore 56.

The body 72 shown in FIGS. 10-14 includes flutes 76 extending substantially parallel to the longitudinal axis L. The flutes 76 compensate for thermal expansion of the body 72 when the firearm 10 becomes heated during use and accommodate for dirt in the hand guard bore 56 to ensure that the body 72 remains freely slideable along the hand guard bore 56.

The base 68, 168 of the handle assembly 66, 166 is slideably supported by the hand guard 36. Specifically, the hand guard 36 defines a slot 78 extending substantially parallel to the longitudinal axis L and the handle assembly 66, 166, specifically at least one of the body 72, 172 and the slider 74, 174, extends through the slot 78 from an interior of the hand guard 36 to an exterior of the hand guard 36. More specifically, the hand guard 36 defines a first slot 80 and a second slot 82 spaced from each other about the longitudinal axis L, as shown in FIG. 7. The handle assembly 66, 166 extends through at least one of the slots 78 from the interior of the hand guard 36 to the exterior of the hand guard 36 and is slideably supported by the hand guard 36 in the first 80 and/or second 82 slots.

The hand guard 36 guides the handle assembly 66, 166 in the charging motion and the forward assist motion. This guidance is created by the complimentary configuration of the body 72, 172 relative to the hand guard bore 56 and by the handle assembly 66, 166 extending through the first 80 and/or second 82 slots and being slideaebly supported by the hand guard 36 in the first 80 and/or second 82 slots.

The base 68, 168, and more specifically the body 72, 172, defines a base bore 84, also referred to as a body bore. The base bore 84 extends along a base bore axis B and slideably receives the rod 62 along the base bore axis B. The base bore 84 is substantially parallel to the longitudinal axis L. Under normal operation, when the firearm 10 is fired the rod 62 moves within the base 68, 168 along the base bore 84 as the bolt carrier 18 moves between the rearward and firing positions while the handle assembly 66, 166 is retained in position relative to the hand guard 36. In other words, the handle assembly 66, 166 does not move during normal firing operation of the firearm 10.

Figure 13:
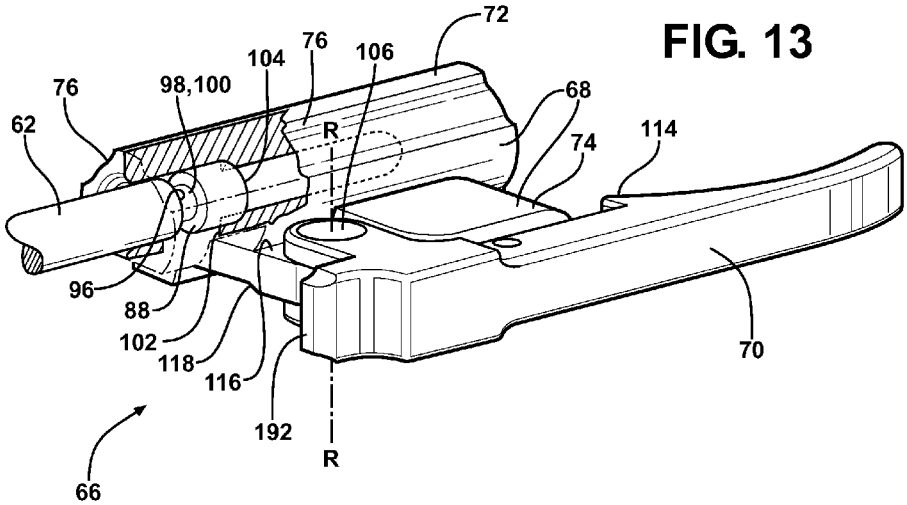
FIG. 13 is a partially cross-sectional perspective view of the first embodiment of the handle assembly and the rod with the handle assembly in a disengaged position.
Figure 14:
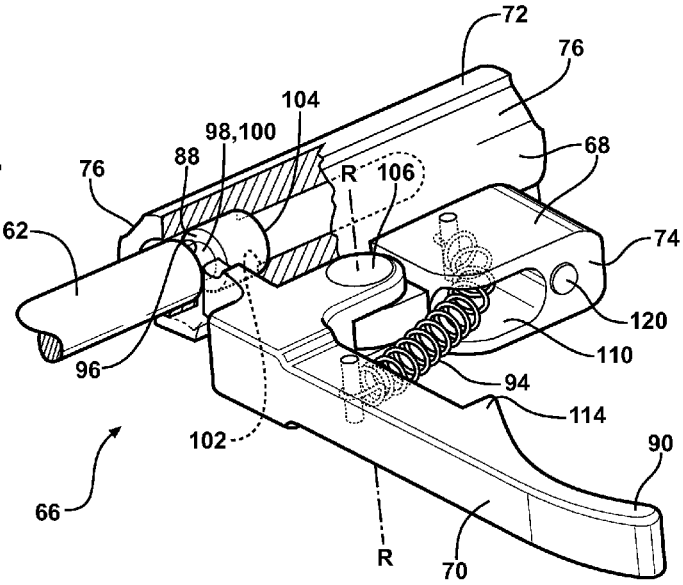
FIG. 14 is a partially cross-sectional perspective view of the first embodiment of the handle assembly and the rod with the handle assembly in an engaged position.
Figure 20:
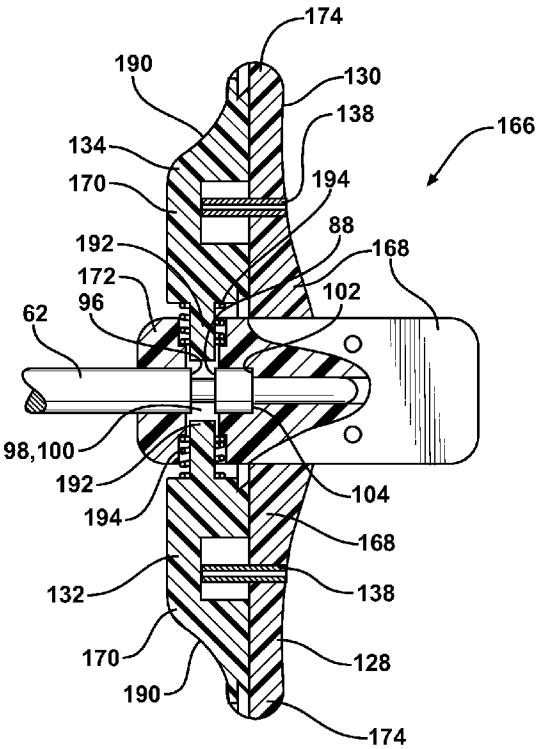
FIG. 20 is a partially cross-sectional view of the second embodiment of the handle assembly in a disengaged position.
Figure 19:
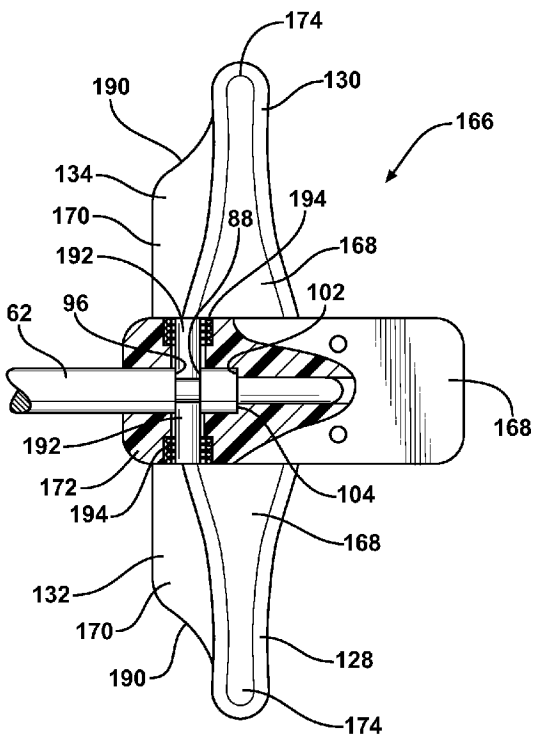
FIG. 19 is a partially cross-sectional view of the second embodiment of the handle assembly in an engaged position.

The arm 70, 170 is selectively moveable relative to the slider 74, 174 transversely to the base bore axis B between a disengaged position, shown in FIGS. 13 and 20, and an engaged position, shown in FIGS. 14 and 19. In the disengaged position the arm 70, 170 is disposed outside of the base bore 84 such that the rod 62 can freely slide in the base 68, 168 along the base bore 84. In the engaged position the arm 70, 170 is disposed at least partially in the base bore 84 for engaging the rod 62. When engaged with the rod 62 in the engaged position, the handle assembly 66, 166 is fixed relative to the rod 62 such that movement of the handle assembly 66, 166 moves the rod 62. It should be appreciated that some play can exist between the handle assembly 66, 166 and the rod 62 when the handle assembly 66, 166 is in the engaged position and in any event, movement of the handle assembly 66, 166 ultimately moves the rod 62 when the handle assembly 66, 166 is in the engaged position.

As best shown in FIGS. 9 and 15, the rod 62 has a forward assist surface 88 and a charging surface 96 each extending transversely to the longitudinal axis L. When moved to the engaged position, the arm 70, 170 is typically adjacent both the forward assist surface 88 and the charging surface 96. In any event, the arm 70, 170 abuts the forward assist surface 88 when moved into the engaged position and in the forward assist motion and the handle assembly 66, 166 abuts the charging surface 96 when moved into the engaged position and in the charging motion.

The rod 62 defines a recess 98 extending transverse to the longitudinal axis L. When moved to the engaged position, the arm 70, 170 extends into the recess 98 to engage the rod 62 in the recess 98. As shown in the Figures, the recess 98 is further defined as an annular groove 100 with the arm 70, 170 abutting the rod 62 in the annular groove 100 when in the engaged position. Specifically, the forward assist surface 88 and the charging surface 96 oppose each other in the annular groove 100. Each of the forward assist surface 88 and the charging surface 96 extend transversely to the base bore axis B. The arm 70, 170 abuts the forward assist surface 88 when moved into the engaged position and in the forward assist motion. The arm 70, 170 abuts the charging surface 96 when moved into the engaged position and in the charging motion.

As shown in FIGS. 13-14 and 18-20, the base 68, 168 of the handle assembly 66, 166 has a ledge 102 extending into the base bore 84 transversely to the longitudinal axis L. The rod 62 includes a lip 104 engaging the ledge 102 when the handle assembly 66, 166 is moved in the charging motion to move the bolt carrier 18 toward a rearward position. The engagement between the ledge 102 of the base 68, 168 and the lip 104 of the rod 62 functions in addition to, or in the alternative to, the engagement between the arm 70, 170 and the charging surface 96 to move the rod 62 and the bolt carrier 18 toward the rearward position when the handle assembly 66, 166 is moved in the charging motion.

Specifics of the first embodiment of the handle assembly 66 are described in greater detail in the following paragraphs with reference to FIGS. 9-14. As shown in FIGS. 13 and 14, the arm 70 is rotatably coupled to the base 68 about a rotational axis R and is rotatable relative to the base 68 between the engaged position and the disengaged position.

The handle assembly 66 includes a pivot pin 106 that extends through the arm 70 and the slider 74 along the rotational axis R. The arm 70 rotates about the pivot pin 106 between the engaged and disengaged positions. The arm 70 includes a grip 90 disposed on one side of the pivot pin 106 and a finger 92 disposed on the opposite side of the pivot pin 106.

The body 72 defines a cutout 108. A user of the firearm 10 can pull the grip 90 from the disengaged position to rotate the arm 70 about the pivot pin 106. When the arm 70 is rotated about the pivot pin 106, the finger 92 extends into the cutout 108. If necessary, the handle assembly 66 can be moved along the hand guard 36 until the cutout 108 is aligned with the annular groove 100 of the rod 62. When the annular groove 100 of the rod 62 is aligned with the cutout 108 of the handle assembly 66, the arm 70 can be further rotated about the pivot pin 106 to the engaged position.

When at rest, the handle assembly 66 is typically in the disengaged position with the arm 70 extending substantially parallel to the longitudinal axis L. The body 72 of the handle assembly 66 defines a pocket 110. A spring 94 is disposed in the pocket 110 and is coupled to the base 68, specifically the slider 74, and the arm 70 for urging the arm 70 toward the disengaged position, specifically with the arm 70 extending substantially parallel to the longitudinal axis L. For example, the spring 94 is retained to the base 68 and the arm 70 with retainer pins, shown in FIG. 11.

Referring again to FIGS. 9, 13, and 14, the hand guard 36 defines a notch 112 and the arm 70 includes a projection 114 nesting with the notch 112 when the arm 70 is rotated to the disengaged position substantially parallel to the longitudinal axis L. The spring 94 releasably retains the projection 114 of the arm 70 in the notch 112 of the hand guard 36. In other words, the user of the firearm 10 can rotate the arm 70 about the rotational axis R as set forth above to remove the projection 114 from the notch 112. When the firearm 10 is fired, the nesting of the projection 114 in the notch 112 retains the handle assembly 66 at a forward end as the rod 62 moves along within the body 72 along the base bore 84.

The handle assembly 66 is ambidextrous. In other words, the handle assembly 66 can extend from either side of the hand guard 36 depending upon which hand the user prefers to use to move the handle assembly 66 in the charging motion and the forward assist motion. Specifically, the slider 74 and the body 72 are selectively arranged in a first configuration with the handle assembly 66 extending from the hand guard 36 only through the first slot 80 and a second configuration with the handle assembly 66 extending from the hand guard 36 only through the second slot 82.

As best shown in FIG. 11, the slider 74 includes a first surface 116 and a second surface 118 spaced from each other. The first surface 116 and the second surface 118 are mirror images of each other. The body 72 abuts the first surface 116 in the first configuration and the body 72 abuts the second surface 118 in the second configuration. In other words, in the first configuration, the body 72 abuts the first surface 116 such that the handle assembly 66 extends through the first slot 80 when assembled to the hand guard 36. In the second configuration, the slider 74 is flipped over relative to the body 72 so that the body 72 abuts the second surface 118 such that the handle assembly 66 extends through the second slot 82 when assembled to the hand guard 36.

As best shown in FIG. 12, an assembly pin 120 is supported by the slider 74 with the assembly pin 120 engageable with the body 72. The assembly pin 120 extends through the slider 74 and the body 72 to connect the slider 74 and the body 72. The assembly pin 120 retains the body 72 to the slider 74 when in either of the first and second configurations.

The assembly pin 120 is housed within an assembly bore 148 and extends through the slider 74 transversely to the longitudinal axis L. The assembly pin 120 can be slid in the assembly bore 148 and is maintained in the assembly bore 148, i.e., the assembly pin 120 cannot be easily removed from the slider 74. Specifically, a plunger 122 extends into the slider 74 to slideably retain the pin to the slider 74. The assembly pin 120 defines a channel 124 and the plunger 122 includes a tip 126 that slides within the channel 124 as the assembly pin 120 is moved relative to the slider 74. The ends of the channel 124 are closed such that as the assembly pin 120 is slid to the end of the channel 124, the tip 126 abuts the end of the channel 124 and retains the assembly pin 120 in the slider 74. It should be appreciated that the plunger 122 can be assembled to the slider 74 in any fashion, such as threaded engagement, adhesive engagement, pinned engagement, etc., without departing from the nature of the present invention.

Referring to FIG. 14 and using directions relative to that Figure for exemplary purposes, to change the configuration of the handle assembly 66, the assembly pin 120 is slid to the left until it is slid entirely through the body 72. As such, the body 72 is freed from the slider 74. The slider 74 and the arm 70 are removed from the first slot 80 of the hand guard 36 as a unit. The slider 74 is flipped over and inserted into the second slot 82 such that the body 72 abuts the second surface 118. The assembly pin 120 is then slid back into engagement with the body 72 to connect the body 72 to the slider 74.

Specifics of the second embodiment of the handle assembly 166 are described in greater detail in the following paragraphs with reference to FIGS. 15-20. As shown in FIGS. 19 and 20, the arm 170 is slideably coupled to the base 168 and is slideable relative to the base 168 between the engaged position and the disengaged position.

The base 168 extends simultaneously from the first slot 80 and the second slot 82. Specifically, the slider 174 is further defined as a first slider 128 and a second slider 130 each extending in different directions from the body 172. The first slider 128 extends through the first slot 80 and the second slider 130 extends through the second slot 82. In addition to or in the alternative, the body 172 and/or the arm 170 can extend through the first 80 and second 82 slots and, in any event, the handle assembly 166 extends simultaneously through the first slot 80 and the second slot 82. As such the handle assembly 166 is ambidextrous.

The arm 170 is further defined as a first arm 132 supported by the first slider 128 and a second arm 134 supported by the second slider 130. The first 132 and second 134 arms are each slid relative to the first 128 and second 130 sliders, respectively, toward the base bore axis B to the engaged position.

The first 132 and second 134 arms are slideably coupled to the first 128 and second 130 sliders, respectively. For example, the first 128 and second 130 sliders can define slits 136 that receive the first 132 and second 134 arms, respectively, in a dovetail configuration. The first 128 and second 130 sliders can include guide pins 138 and the first arms 132 can include guide slots slideably receiving the guide pins 138 of the first 128 and second 130 sliders.

Each of the first 132 and second 134 arms include a grip 190 and a finger 192 extending therefrom toward the base bore axis B. In the engaged position, at least one of the fingers 92 extend into the annular groove 100 of the rod 62. In the disengaged position, the fingers 92 are spaced from the annular groove 100.

When at rest, the first 132 and second 134 arms are biased toward the disengaged position. For example, springs 194, shown in FIGS. 19 and 20, can be disposed about the fingers 92 between the arms and the body 172 to urge the first 132 and second 134 arms toward the disengaged position. The first 132 and second 134 arms are moved toward the engaged position by sliding the first 132 and second 134 arms toward the base bore axis B to overcome the springs 194.

A user of the firearm 10 can slide either, or both, of the first 132 and second 134 arms toward each other, i.e., toward the base bore axis B. When the first 132 and second 134 arms are slid toward each other, the fingers 92 extend into the annular groove 100 of the rod 62. If necessary, the handle assembly 166 can be moved along the hand guard 36 until the finger 192 is aligned with the annular groove 100 of the rod 62. When the annular groove 100 of the rod 62 is aligned with the finger 192, the arm 170 can be slid further toward the base bore axis B to the engaged position.

When the finger 192 of the arm 170 is disposed in the annular groove 100 of the rod 62, the handle assembly 166 is fixed in position relative to the rod 62. When in the engaged position, the user can move the handle assembly 166 in the charging motion to move the rod 62 and bolt carrier 18 toward the rearward position or in the forward assist motion to move the rod 62 and the bolt carrier 18 toward the firing position.

The handle assembly 166 is typically releasably retained at the forward end of the first 80 and second 82 slots. Specifically, the hand guard 36 defines at least one indentation 140, as shown in FIG. 15, and the base 168 includes at least one detent 142 selectively engageable with the indentation 140 for retaining the handle assembly 166 along the longitudinal axis L. The engagement of the detent 142 with the indentation 140 retains the handle assembly 166 at the forward end of the first 80 and second 82 slots. In the figures, the indentations 140 are shown in the hand guard 36 and the detents 142 are shown in the handle assembly 166 for exemplary purposes. The indentations 140 can be on either of the hand guard 36 and the handle assembly 166 and the detent 142 can be on the other of the hand guard 36 and the handle assembly 166 without departing from the nature of the present invention.

The firearm 10 described herein is designed to permit easy retro-fitting of the components to a variety of currently and/or previously manufactured firearm 10 designs including direct gas impingement systems and indirect gas impingement systems. For example, the firearm 10 components described herein may be retro-fitted to the M16, the M4®, such as the M4® carbine and the AR-15®, such as the AR-15® Platform. A version of the M4®, including a shorter barrel 42 typically associated with the M4®, is shown in FIGS. 1 and 2. A version of the M16, including a longer barrel 42 typically associated with the M16, is shown in FIG. 3. It is to be appreciated that there are several different manufacturers producing firearms 10 having similar components, appearance and operation to the M16, the M4® and the AR-15®; therefore, the firearm 10 described herein is applicable to firearms 10 outside the M16, M4® and AR-15® designs.

The handle assembly 66, 166 is designed to permit easy retro-fitting of existing firearms 10. For example, the firearm 10 shown in FIG. 1 includes a version of a standard charging handle 144 and a version of a standard forward assist mechanism 146. The firearm 10 shown in FIG. 1 is retrofitted with the handle assembly 66, 166, which can be used to perform the function of both the standard charging handle 144 and the standard forward assist mechanism 146. The handle assembly 66, 166 is duplicative of the standard charging handle 144 and the standard forward assist mechanism 146 but provides the advantages described above. As such, existing firearms 10 can merely be retrofitted with the handle assembly 66, 166 to gain the advantages of the handle assembly 66, 166 without the need of producing new firearms 10. As shown in FIG. 2, the firearm 10 can also be produced without the standard charging handle and the standard forward assist mechanism such that only the handle assembly 66, 166 is utilized to perform these functions. Although a new receiver configuration is required, the configuration shown in FIG. 2 is advantageous because duplicate parts are eliminated, thereby reducing the complexity, cost, and weight of the firearm 10.

The invention has been described in an illustrative manner, and it is to be understood that the terminology which has been used is intended to be in the nature of words of description rather than of limitation. Obviously, many modifications and variations of the present invention are possible in light of the above teachings, and the invention may be practiced otherwise than as specifically described.

What is claimed is:

1. A firearm comprising:

a receiver defining a receiver bore extending along a longitudinal axis;

a bolt carrier disposed in said receiver bore and moveable relative to said receiver along said longitudinal axis between a firing position and a rearward position;

an elongated member fixed relative to said bolt carrier and extending substantially parallel to said longitudinal axis;

a hand guard coupled to said receiver and disposed about said elongated member; and a handle assembly disposed in said hand guard and moveable toward said receiver to define a charging motion and away from said receiver to define a forward assist motion with said handle assembly engaging said elongated member during both of said charging motion and said forward assist motion, said handle assembly including:

a base disposed in said hand guard; and an arm coupled to said base and moveable between a disengaged position spaced from said elongated member and an engaged position abutting said elongated member with said arm moving said elongated member and said bolt carrier toward said firing position when in said engaged position and when said handle assembly is moved in said forward assist motion and with said arm moving said elongated member and said bolt carrier toward said rearward position when in said engaged position and when said handle assembly is moved in said charging motion.

2. The firearm as set forth in claim 1 wherein said arm is moveable transversely to said longitudinal axis between said disengaged and engaged positions.

3. The firearm as set forth in claim 1 wherein said base is slideably supported by said hand guard and supports said arm.

4. The firearm as set forth in claim 3 wherein said arm is rotatably coupled to said base about a rotational axis and is rotatable relative to said base between said engaged position and said disengaged position.

5. The firearm as set forth in claim 4 wherein one of said arm and said hand guard defines a notch and the other of said arm and said hand guard includes a projection nesting with said notch when said arm is rotated to said disengaged position for selectively retaining said handle assembly in position relative to said hand guard.

6. The firearm as set forth in claim 3 wherein said arm is slideably coupled to said base and is slideable relative to said base between said engaged position and said disengaged position.

7. The firearm as set forth in claim 3 wherein at least one of said hand guard and said base defines an indentation and the other of said hand guard and said base includes a detent selectively engageable with said indentation for retaining said handle assembly in position relative to said hand guard.

8. The firearm as set forth in claim 3 further comprising a spring coupled to said base and said arm for urging said arm toward said disengaged position.

9. The firearm as set forth in claim 1 wherein said base of said handle assembly includes a slider slideable along said hand guard and supporting said arm and a body connected to said slider and receiving said elongated member.

10. The firearm as set forth in claim 1 wherein said hand guard defines a slot extending substantially parallel to said longitudinal axis and wherein said handle assembly extends through said slot from an interior of said hand guard to an exterior of said hand guard.

11. The firearm as set forth in claim 1 wherein said hand guard defines a first slot and a second slot spaced from each other about said longitudinal axis and wherein said handle assembly extends through at least one of said slots from an interior of said hand guard to an exterior of said hand guard.

12. The firearm as set forth in claim 11 wherein said base slideably engages said hand guard and supports said arm and wherein at least one of said base and said arm extends simultaneously from said first slot and said second slot.

13. The firearm as set forth in claim 11 wherein said base of said handle assembly includes a slider slideable along said hand guard and supporting said arm and a body connected to said slider and receiving said elongated member and wherein said slider and said body are selectively arranged in a first configuration with said handle assembly extending from said hand guard only through said first slot and a second configuration with said handle assembly extending from said hand guard only through said second slot.

14. The firearm as set forth in claim 13 wherein said slider includes a first surface and a second surface spaced from each other with said body abutting said first surface in said first configuration and with said body abutting said second surface in said second configuration.

15. The firearm as set forth in claim 13 further comprising a pin supported by said slider with said pin engageable with said body and retaining said body to said slider when in either of said first and second configurations.

16. The firearm as set forth in claim 1 wherein said elongated member defines an annular groove with said arm abutting said elongated member in said annular groove when in said engaged position.

17. The firearm as set forth in claim 1 wherein said elongated member has a forward assist surface and a charging surface each extending transversely to said longitudinal axis and wherein said arm abuts said forward assist surface when moved into said engaged position and in said forward assist motion and wherein said handle assembly abuts said charging surface when moved into said engaged position and in said charging motion.

18. The firearm as set forth in claim 1 wherein said base has a base bore receiving said elongated member.

19. The firearm as set forth in claim 18 wherein said base of said handle assembly has a ledge extending into said base bore transversely to said longitudinal axis and wherein said elongated member includes a lip engaging said ledge when said handle assembly is moved in said charging motion.

20. The firearm as set forth in claim 18 wherein said base bore receives said elongated member during both of said charging and forward assist motions.

21. The firearm as set forth in claim 1 wherein said base at least partially receives said elongated member during both of said charging motion and said forward assist motion.

22. The firearm as set forth in claim 1 wherein said hand guard slideably supports said handle assembly.

23. A charging mechanism for a firearm, said charging mechanism comprising:

a bolt carrier extending along a longitudinal axis;

an elongated member fixed relative to said bolt carrier and extending substantially parallel said longitudinal axis and defining a recess extending transverse to said longitudinal axis; and a handle assembly having a base and being moveable with said elongated member in one direction along said longitudinal axis in a charging motion and in an opposite direction along said longitudinal axis in a forward assist motion;

said handle assembly engaging said elongated member during said charging motion for moving said bolt carrier toward a rearward position; and said handle assembly having an arm supported by said base and being selectively moveable transversely to said longitudinal axis between a disengaged position spaced from said elongated member and an engaged position abutting said elongated member in said recess wherein said arm in said engaged position is fixed to said elongated member for moving said bolt carrier toward a firing position during movement of said handle assembly in said forward assist motion and toward a rearward position during movement of said handle assembly in said charging motion.

24. The charging mechanism as set forth in claim 23 wherein said recess is further defined as an annular groove with said arm abutting said elongated member in said annular groove when in said engaged position.

25. The charging mechanism as set forth in claim 24 wherein said elongated member has a forward assist surface and a charging surface opposing each other in said annular groove and each extending transversely to said longitudinal axis and wherein said arm abuts said forward assist surface when moved into said engaged position and in said forward assist motion and wherein said handle assembly abuts said charging surface when moved into said engaged position and in said charging motion.

26. The charging mechanism as set forth in claim 23 wherein said base defines a base bore receiving said rod.

27. The firearm as set forth in claim 26 wherein said base of said handle assembly has a ledge extending into said base bore transversely to said longitudinal axis and wherein said elongated member includes a lip engaging said ledge when said handle assembly is moved in said charging motion.

28. The charging mechanism as set forth 23 wherein said base at least partially receives said elongated member during both of said charging motion and said forward assist motion.

29. A handle assembly for a charging mechanism of a firearm having a bolt carrier and a rod fixed relative to and extending from the bolt carrier, said handle assembly comprising:

a body defining a body bore extending along a body bore axis for slideably receiving the rod along said body bore axis;

a ledge extending into said body bore for engaging the rod when moved in a charging motion to move the bolt carrier toward a rearward position;

a slider fixed to said body and extending transversely to said body bore axis for slideably engaging the firearm in the charging motion and a forward assist motion; and an arm supported by said slider and being selectively moveable transversely to said body bore axis between a disengaged position disposed outside of said body bore and an engaged position disposed at least partially in said body bore for engaging the rod when moved in the forward assist motion to move the bolt carrier toward a firing position.

30. The handle assembly as set forth in claim 29 wherein said arm is rotatably coupled to said slider about a rotational axis and is rotatable relative to said slider between said engaged position and said disengaged position.

31. The handle assembly as set forth in claim 29 wherein said arm is slideably coupled to said slider and is slideable relative to said slider between said engaged position and said disengaged position.

32. The handle assembly as set forth in claim 31 wherein said slider is further defined as a first slider and a second slider each extending in different directions from said body.

33. The handle assembly as set forth in claim 32 wherein said arm is further defined as a first arm supported by said first slider and a second arm supported by said second slider.

34. The handle assembly as set forth in claim 33 wherein said first and second arms are slideably coupled to said first and second sliders, respectively, and wherein said first and second arms are each slid relative to said first and second sliders, respectively, toward said body bore axis to said engaged position.

35. The handle assembly as set forth in claim 29 further comprising a spring coupled to at least one of said body and said slider and to said arm for urging said arm toward said disengaged position.

36. The handle assembly as set forth in claim 35 wherein said slider includes a first surface and a second surface spaced from each other with said body abutting said first surface in a first configuration and with said body abutting said second surface in a second configuration.

37. The handle assembly as set forth in claim 35 further comprising a pin supported by said slider with said pin engageable with said body and retaining said body to said slider when in either of said first and second configurations.

* * * * *